US010598460B1

(12) United States Patent
Peacemaker et al.

(10) Patent No.: US 10,598,460 B1
(45) Date of Patent: Mar. 24, 2020

(54) POWER ASSISTED BOW WITH ENERGY STORAGE AND RELOCK MECHANISM

(71) Applicant: SOS Solutions, Inc., Tonasket, WA (US)

(72) Inventors: Samuel R. Peacemaker, Gilbert, AZ (US); Benjamin Peacemaker, Chandler, AZ (US)

(73) Assignee: SOS Solutions, Inc., Tonasket, WA (US)

( * ) Notice: Subject to any disclaimer, the term of this patent is extended or adjusted under 35 U.S.C. 154(b) by 0 days.

(21) Appl. No.: 16/380,519

(22) Filed: Apr. 10, 2019

(51) Int. Cl.
*F41B 5/10* (2006.01)
*F41B 5/14* (2006.01)

(52) U.S. Cl.
CPC ..... *F41B 5/1484* (2013.01); *F41B 5/10* (2013.01); *F41B 5/105* (2013.01); *F41B 5/1411* (2013.01)

(58) Field of Classification Search
CPC ..... F41B 5/00; F41B 5/10
See application file for complete search history.

(56) References Cited

U.S. PATENT DOCUMENTS 4,471,747 A * 9/1984 Nishioka ..... F41B 5/10 124/23.1
4,478,202 A * 10/1984 Anderson ..... F41B 5/10 124/23.1
4,757,799 A * 7/1988 Bozek ..... F41B 5/10 124/25.6
4,817,580 A * 4/1989 Butterfield ..... F41B 5/10 124/25.6
5,150,699 A * 9/1992 Boissevain ..... F41B 5/0094 124/23.1
5,503,135 A * 4/1996 Bunk ..... F41B 5/0094 124/16
5,931,146 A * 8/1999 Schrader ..... F41B 5/10 124/23.1
9,086,249 B2 * 7/2015 Peacemaker ..... F41B 5/10
2014/0261356 A1 * 9/2014 Peacemaker ..... F41B 5/1403 124/23.1

* cited by examiner

*Primary Examiner* — John A Ricci
(74) *Attorney, Agent, or Firm* — Snell & Wilmer LLP

(57) ABSTRACT

The present disclosure provides an energy storage and relock mechanism for a power assisted bow comprising a charge cam and a lock plate adjacent to the charge cam. The charge cam may be configured to store potential energy by rotating in a first direction and the lock plate may be configured urge rotation of the charge cam in the first direction to lock potential energy in the power assisted bow.

20 Claims, 14 Drawing Sheets

POWER ASSISTED BOW WITH ENERGY STORAGE AND RELOCK MECHANISM

FIELD OF THE DISCLOSURE

The present disclosure relates to a compound bow system, and more specifically, to a power assisted bow with an energy storage and relock mechanism.

BACKGROUND OF THE DISCLOSURE

Conventional compound bow systems utilize a plurality of cables and cams to store energy in the limbs of the compound bow, which may be released to launch a projectile such as an arrow. Typically, the cams are configured to rotate in response to a user pulling a drawstring, thereby charging the bow limbs to achieve an adequate output force to launch the arrow at an intended velocity. However, in some cases, the force associated with fully charging the compound bow by pulling the drawstring to a fully drawn position may be too great for some users.

Some compound bows may attempt to solve the above-stated problem by allowing a portion of the output energy to be stored as potential energy in the compound bow prior to a user pulling the drawstring to generate additional potential energy. However, such compound bows may lack the capability to maintain the stored potential energy in the compound bow in the event the user wishes to release the drawstring but not release the energy in the compound bow.

SUMMARY OF THE DISCLOSURE

An energy storage and relock mechanism for a power assisted bow may comprise a charge cam and a lock plate adjacent to the charge cam, wherein the charge cam may be configured to store potential energy by rotating in a first direction and wherein the lock plate may be configured urge rotation of the charge cam in the first direction to lock potential energy in the power assisted bow.

In various embodiments, the energy storage and relock mechanism may further comprise a charge cam lock washer coupled to the charge cam and configured to interface with the lock plate. The charge cam lock washer may comprise a tooth extending radially from the charge cam lock washer and the lock plate may comprise a first tooth and a second tooth extending radially from the lock plate. The first tooth of the lock plate may be configured to contact the tooth of the charge cam lock washer to urge rotation of the charge cam in the first direction. The lock plate may comprise a biasing member configured to urge rotation of the lock plate to allow rotation of the charge cam in a second direction. The energy storage and relock mechanism may further comprise a relock cord coupled to the lock plate and a relock lever coupled to the relock cord, wherein the lock plate may be configured to urge rotation of the charge cam in the first direction through actuation of the relock lever. The charge cam may be configured to be coupled to a first charge cable on a first end and coupled to a second charge cable on a second end. The first charge cable and the second charge cable may be configured to become tensioned in response to the charge cam rotating in the first direction. The energy storage and relock mechanism may further comprise an attachment member configured to couple the energy storage and relock mechanism to a central body of the power assisted bow.

A power assisted bow may comprise an energy storage and relock mechanism, comprising a charge cam and a lock plate adjacent to the charge cam, wherein the charge cam may be configured to store potential energy by rotating in a first direction and wherein the lock plate may be configured urge rotation of the charge cam in the first direction to lock potential energy in the power assisted bow.

In various embodiments, the power assisted bow may further comprise a first charge cable and a second charge cable coupled to the charge cam and configured to become tensioned in response to the charge cam rotating in the first direction. The power assisted bow may further comprise a first auxiliary limb and a second auxiliary limb coupled to the first charge cable and second charge cable, respectively, the first auxiliary limb and the second auxiliary limb configured to deflect inwardly in response to the charge cam rotating in the first direction. The energy storage and relock mechanism may be coupled to a central body of the power assisted bow adjacent to a grip. The power assisted bow may further comprise a charge cam lock washer coupled to the charge cam and configured to interface with the lock plate. A first tooth of the lock plate may be configured to contact a tooth of the charge cam lock washer to urge rotation of the charge cam in the first direction. The lock plate may comprise a biasing member configured to urge rotation of the lock plate to allow rotation of the charge cam in a second direction. The charge cam may be configured to store a fraction of a total amount of potential energy to be stored in the power assisted bow by rotating in the first direction.

A method of storing and relocking potential energy in a power assisted may comprise storing a first amount of potential energy in the power assisted bow via an energy storage and relock mechanism, locking the first amount of potential energy in the power assisted bow via the energy storage and relock mechanism, generating a second amount of potential energy in the power assisted bow in response to a drawstring of the power assisted bow being pulled, relocking the first amount of potential energy in the power assisted bow via the energy storage and relock mechanism, and relieving the second amount of potential energy in the power assisted bow in response to the drawstring being let down.

In various embodiments, the energy storage and relock mechanism may comprise a charge cam configured to store the first amount of potential energy by rotating in a first direction. The energy storage and relock mechanism may further comprise a lock plate configured to relock the first amount of potential energy by urging rotation of the charge cam in the first direction.

The foregoing features and elements may be combined in various combinations without exclusivity, unless expressly indicated otherwise. These features and elements as well as the operation thereof will become more apparent in light of the following description and the accompanying drawings. It should be understood, however, the following description and drawings are intended to be exemplary in nature and non-limiting.

BRIEF DESCRIPTION OF THE DRAWINGS

The accompanying drawings are included to provide a further understanding of the present disclosure and are incorporated in, and constitute a part of, this specification, illustrate various embodiments, and together with the description, serve to explain the principles of the disclosure.

DETAILED DESCRIPTION

Figure 1:
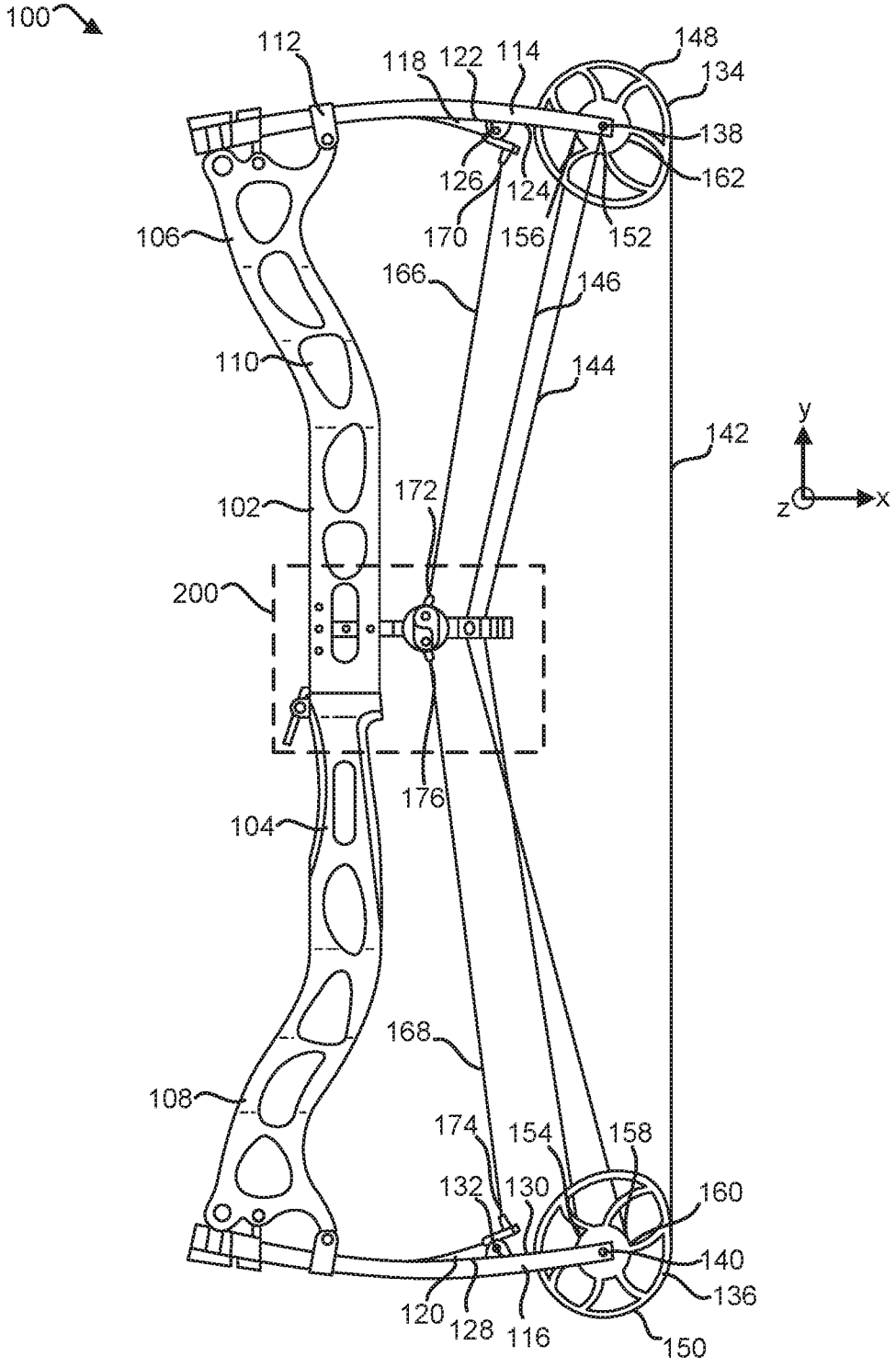
FIG. 1 illustrates a side view of a power assisted bow with an energy storage and relock mechanism in a rest position, in accordance with various embodiments.

The detailed description of various embodiments herein makes reference to the accompanying drawings, which show various embodiments by way of illustration. While these various embodiments are described in sufficient detail to enable those skilled in the art to practice the disclosure, it should be understood that other embodiments may be realized and that logical, chemical, electrical, and mechanical changes may be made without departing from the spirit and scope of the disclosure. Thus, the detailed description herein is presented for purposes of illustration only and not of limitation.

For example, the steps recited in any of the method or process descriptions may be executed in any order and are not necessarily limited to the order presented. Furthermore, any reference to singular includes plural embodiments, and any reference to more than one component or step may include a singular embodiment or step. Also, any reference to attached, fixed, connected, or the like may include permanent, removable, temporary, partial, full, and/or any other possible attachment option. Additionally, any reference to without contact (or similar phrases) may also include reduced contact or minimal contact.

For example, in the context of the present disclosure, methods, systems, and articles may find particular use in connection with compound bows. However, various aspects of the disclosed embodiments may be adapted for performance in a variety of other mechanical systems. As such, numerous applications of the present disclosure may be realized.

Compound bows may include one or more cam assemblies configured to provide a mechanical advantage for a user pulling the drawstring of the compound bow. Typically, the output force of the compound bow is directly dependent on the amount of force required to bring the drawstring to a fully drawn position. In general, as the drawstring is pulled, cams mounted on opposing limbs of the compound bow rotate, thereby deflecting the limbs and storing energy in the bow. The shape and orientation of the cams is configured to provide a mechanical advantage to a user pulling the drawstring. The force required by a user to pull the drawstring may peak shortly after the initial pull and plateau until the drawstring reaches the fully drawn position. However, such a force may be too great for some users.

Recently, certain compound bows have been developed which may allow a portion of the output energy to be prestored as potential energy in the compound bow before the remaining energy is generated by pulling the drawstring. Compound bows such as these may allow a user to pull the drawstring to store a fraction of the total energy to be released from the system, thereby allowing a user lacking the requisite strength to operate a bow with greater output energy, and therefore, greater arrow velocity. However, such compound bows may lack the ability to allow a user to release the energy resulting from the user pulling the drawstring, without also releasing the potential energy prestored in the compound bow. Such functionality may be beneficial in the event the user is not ready to release the arrow for various reasons.

Accordingly, with reference to FIG. 1, a side view of a power assisted bow 100 with an energy storage and relock mechanism 200 is illustrated in a rest position, in accordance with various embodiments. Power assisted bow 100 may comprise a central body 102 comprising a grip 104, a first member 106, and a second member 108, and one or more limb brackets 112 positioned at terminal ends of first member 106 and second member 108. Central body 102 may comprise an elongated member, wherein first member 106 may form an upper portion (positive y-direction), while second member 108 may form a lower portion (negative y-direction). Central body 102 may be configured to receive one or more bow components, including limbs, sights, stabilizer bushings, or other components. Central body 102 may comprise one or more cutouts 110 configured to reduce a weight of power assisted bow 100. Limb brackets 112 may be configured to receive a corresponding number of limbs such as a first main limb 114, a second main limb 116, a first auxiliary limb 118, and a second auxiliary limb 120. Energy storage and relock mechanism 200 may be coupled to central body 102 proximate grip 104 of central body 102, in various embodiments.

As previously stated, power assisted bow 100 may comprise a first main limb 114 and a second main limb 116. First main limb 114 may be coupled to a terminal end of first member 106, while second main limb 116 may be coupled to a terminal end of second member 108. Similarly, power assisted bow 100 may comprise a first auxiliary limb 118 and a second auxiliary limb 120. First auxiliary limb 118 may be coupled to a terminal end of first member 106, while second auxiliary limb 120 may be coupled to a second terminal end of second member 108. As such, in various embodiments, first main limb 114 and first auxiliary limb 118 may be positioned on an opposite end of central body 102 than second main limb 116 and second auxiliary limb 120.

First auxiliary limb 118 may be coupled to power assisted bow 100 such that first auxiliary limb 118 is positioned inward (inward referring generally to a direction toward energy storage and relock mechanism 200) of first main limb 114. Similarly, second auxiliary limb 120 may be coupled to power assisted bow 100 such that second auxiliary limb 120 is positioned inward of second main limb 116. In various embodiments, an outer surface 122 of first auxiliary limb 118 may be configured to contact an inner surface 124 of first main limb 114 at first contact location 126. An outer surface 128 of second auxiliary limb 120 may be configured contact an inner surface 130 of second main limb 116 at second contact location 132. As will be discussed further below, first main limb 114 and second main limb 116 may be configured to relieve potential energy in first auxiliary limb 118 and second auxiliary limb 120 via first contact location 126 and second contact location 132.

In various embodiments, power assisted bow 100 may comprise various materials. For example, central body 102, grip 104, first member 106, and/or second member 108 may comprise an aluminum, aluminum alloy, composite material, or other suitable material. First main limb 114, second main limb 116, first auxiliary limb 118, and/or second auxiliary limb 120 may comprise a composite material or another resilient material capable of elastically deflecting to store potential energy and release stored energy when returning to a non-deflected position.

Power assisted bow 100 may further comprise a first cam 134 rotatably mounted to an end of first main limb 114 and a second cam 136 rotatable mounted to an end of second main limb 116. As would be appreciated to one of ordinary skill in the art, first cam 134 and second cam 136 may each comprise a substantially ovoid geometry and be configured to rotate about a single point. In various embodiments, first main limb 114 may comprise a split limb comprising two members separated at one end. Similarly, second main limb 116 may comprise a split limb comprising two members separated at one end. First cam 134 and second cam 136 may be configured to be positioned between the two members of first main limb 114 and second main limb 116, respectively. First main limb 114 and second main limb 116 may each comprise one or more apertures configured to receive a first rotational member 138 and a second rotational member 140, respectively, such that first cam 134 and second cam 136 may be configured to rotate. First rotational member 138 and second rotational member 140 may be configured to be inserted into one or more apertures extending through first cam 134, second cam 136, first main limb 114, and second main limb 116.

Power assisted bow 100 comprises a drawstring 142, a first buss cable 144, and a second buss cable 146, in accordance with various embodiments. Drawstring 142 may be coupled on a first end 148 to first cam 134 and coupled on a second end 150 to second cam 136. First end 148 may wrap around a portion of a profile of first cam 134 and second end 150 may wrap around a portion of a profile of second cam 136. First cam 134 may be configured to rotate in a first direction in response to drawstring 142 being pulled (in the positive x-direction) and second cam 136 may be configured to rotate in a second direction opposite the first direction in response to drawstring 142 being pulled.

First buss cable 144 may be coupled on a first end 152 to first main limb 114 and coupled on a second end 154 to second cam 136. Similarly, second buss cable 146 may be coupled on a first end 156 to second main limb 116 and coupled on a second end 158 to first cam 134. As first cam 134 and second cam 136 rotate in response to drawstring 142 being pulled, first buss cable 144 may wrap around an inner profile 160 of second cam 136 and second buss cable 146 may wrap around an inner profile 162 of first cam 134. In such a way, first buss cable 144 and second buss cable 146, now under tension, may pull first main limb 114 and second main limb 116, respectively, inwardly, thereby storing energy in first main limb 114 and second main limb 116.

Power assisted bow 100 may further comprise a first charge cable 166 and a second charge cable 168. First charge cable 166 may be coupled on a first end 170 to first auxiliary limb 118 and coupled on a second end 172 to energy storage and relock mechanism 200. Likewise, second charge cable 168 may be coupled on a first end 174 to second auxiliary limb 120 and coupled on a second end 176 to energy storage and relock mechanism 200. In various embodiments, first charge cable 166 and second charge cable 168 may be configured to be pulled inwardly via a substantially oval-shaped profile on energy storage and relock mechanism 200, thereby deforming first auxiliary limb 118 and second auxiliary limb 120 to store energy in power assisted bow 100. First charge cable 166, second charge cable 168, first buss cable 144, second buss cable 146, and drawstring 142 may comprise any suitable material, including, for example, linen fiber, hemp fiber, rawhide, a synthetic fiber such as an aramid or para-aramid fiber (e.g., that sold under the trademark KEVLAR), or high-molecular-weight polyethylene material.

Figure 2:
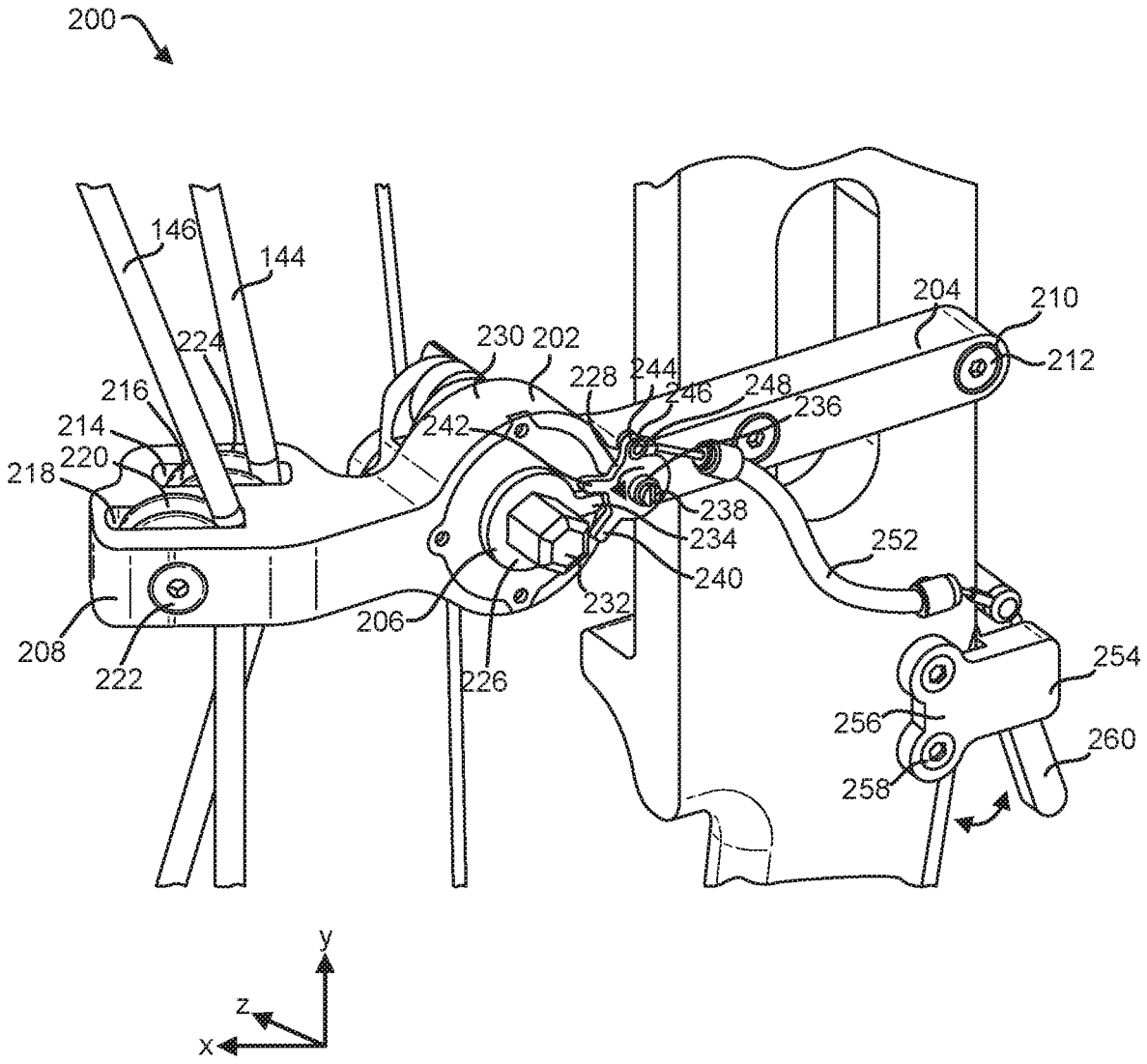
FIG. 2 illustrates a perspective view of an energy storage and relock mechanism of a power assisted bow, in accordance with various embodiments.

Referring now to FIG. 2, a perspective view of energy storage and relock mechanism 200 is illustrated from a rear perspective view, in accordance with various embodiments. Energy storage and relock mechanism 200 may comprise an assembly of various components configured to store energy in power assisted bow 100 through deformation of first auxiliary limb 118 and second auxiliary limb 120. Energy storage and relock mechanism 200 may further be configured to lock a position of first auxiliary limb 118 and second auxiliary limb 120 in the event it is desired to return power assisted bow 100 to a charged, relocked position after pulling the drawstring to a fully drawn position.

Energy storage and relock mechanism 200 may comprise a body 202 comprising an attachment member 204, an energy storage and relock assembly 206, and a roller element member 208. Attachment member 204 may comprise any suitable structure configured to couple energy storage and relock mechanism 200 to a portion of a compound bow, for example, central body 102. As such, in various embodiments, attachment member 204 may comprise an elongated member comprising one or more attachment apertures 210. One or more attachment apertures 210 may be configured to receive an equal number of fasteners 212 to couple energy storage and relock mechanism 200 to power assisted bow 100.

Roller element member 208 may be positioned rearward (in the positive x-direction) of attachment member 204 and be configured to receive first buss cable 144 and second buss cable 146. Roller element member 208 may comprise a first slot 214 configured to house a first roller 216 and a second slot 218 configured to house a second roller 220, in various embodiments. First roller 216 and second roller 220 may be rotatably coupled to roller element member 208 via a first roller element fastener 222 and a second roller element fastener 224. Specifically, roller element member 208 may comprise one or more apertures configured to receive first roller element fastener 222 and second roller element fastener 224 for rotatably mounting first roller 216 and second roller 220 to roller element member 208. As such, first roller 216 and second roller 220 may be configured to freely rotate in response to first buss cable 144 and second buss cable moving up and down (in the y-direction) relative to roller element member 208.

Energy storage and relock assembly 206 may be positioned rearward of attachment member 204 yet forward of roller element member 208. In various embodiments, energy storage and relock assembly 206 may comprise one or more rotating elements configured to mechanically interface to lock or unlock potential energy in the power assisted bow. Energy storage and relock assembly 206 may comprise a first rotating element, for example, a rotatable charge cam lock washer 226, and a second rotating element, for example, a rotatable lock plate 228 configured to interface with charge cam lock washer 226 to prevent and/or allow rotation of charge cam lock washer 226. The first rotating element may be adjacent to the second rotating element. While illustrated in FIG. 2 as comprising a charge cam lock washer 226 and a lock plate 228, the first rotating element and the second rotating element are not limited in this regard and may comprise any suitable structures configured to mechanically interface to cause rotation of the other component. In various embodiments, the first rotating element and the second rotating element may comprise a structure similar to or different than charge cam lock washer 226 and lock plate 228 such as an irregular cam or an irregular gear comprising one or more protrusions extending radially therefrom. Lock plate 228 may prevent stored energy from being released from power assisted bow 100 by mechanically interfering with charge cam lock washer 226.

Energy storage and relock assembly 206 may comprise a housing 230 and a charge shaft 232, in various embodiments. Charge shaft 232 may be configured to rotate 360° relative to housing 230 such that energy may be stored in first auxiliary limb 118 and second auxiliary limb 120 and released as charge shaft 232 rotates relative to housing 230. In various embodiments, charge cam lock washer 226 may be coupled to charge shaft 232 adjacent to housing 230. Charge cam lock washer 226 may comprise an aperture with a shape corresponding to that of charge shaft 232, in various embodiments. Charge cam lock washer 226 may be configured to rotate with charge shaft 232 as charge shaft 232 rotates relative to housing 230. Charge cam lock washer 226 may comprise any suitable shape. For example, in various embodiments, charge cam lock washer 226 may comprise a circular, triangular, square, or any other suitable geometry. Charge cam lock washer 226 may comprise a tooth 234 extending radially outward from an outer surface of charge cam lock washer 226 such that tooth 234 extends a greater distance in the radial direction than the remaining portions of charge cam lock washer 226. As will be discussed further below, tooth 234 may be configured to interface with other components on energy storage and relock assembly 206 in order to store and/or release energy in power assisted bow 100.

Similar to charge cam lock washer 226, lock plate 228 may comprise any suitable geometry, for example, a circular, triangular, square or other suitable geometry. Lock plate 228 may be configured to rotate relative to housing 230 in a first direction and a second direction opposite first direction. In various embodiments, lock plate 228 may be positioned between energy storage and relock assembly 206 and attachment member 204, however, lock plate 228 is not limited in this regard and may be coupled to any suitable portion of energy storage and relock mechanism 200.

In various embodiments, lock plate 228 may comprise an aperture configured to receive and rotate about a shaft 236. Lock plate 228 may further comprise a biasing member 238. Biasing member 238 may comprise a torsion spring in various embodiments, however, is not limited in this regard and may comprise any suitable part configured to provide a biasing rotational force to lock plate 228. For example, biasing member 238 may be configured to bias lock plate 228 such that lock plate 228 desires to rotate in a counterclockwise direction as illustrated in FIG. 2. Lock plate 228 may further comprise a first tooth 240 and a second tooth 242. First tooth 240 and second tooth 242 may extend radially outward from lock plate 228 such that first tooth 240 and second tooth 242 extend a greater distance in the radial direction than the remaining portions of lock plate 228. First tooth 240 and second tooth 242 may be spaced apart in a circumferential direction. In various embodiments, first tooth 240 may be spaced apart from second tooth 242 such that an angle between first tooth 240 and second tooth 242 is between approximately 0° and 180°, between approximately 45° and 135°, or approximately 90°. In various embodiments, first tooth 240 and second tooth 242 may be configured to interface with tooth 234 of charge cam lock washer 226 such that potential energy may be stored and/or released from power assisted bow 100.

Lock plate 228 may further comprise a boss 244. Boss 244 may be circumferentially spaced apart from first tooth 240 and second tooth 242. For example, in various embodiments, boss 244 may be located near a top portion (in the y-direction) of lock plate 228 and extend radially outward from lock plate 228. Boss 244 may comprise an aperture 246 configured to receive a boss shaft 248. Boss shaft 248 may be coupled to a relock cord 252, in various embodiments. Relock cord 252 may be coupled to a relock mechanism 254.

Relock mechanism 254 may comprise an attachment flange 256 configured to be coupled to central body 102 via one or more fasteners 258 and a relock lever 260. Relock lever 260 may be configured to rotate relative to relock lever 260 (in a direction indicated by the arrows), thereby applying a force to lock plate 228 near boss 244 through relock cord 252. Such a force may cause lock plate 228 to rotate in the clockwise direction in FIG. 2. As will be discussed further below, such a movement of lock plate 228 may allow energy storage and relock mechanism 200 to relock energy in power assisted bow 100.

Figure 6:
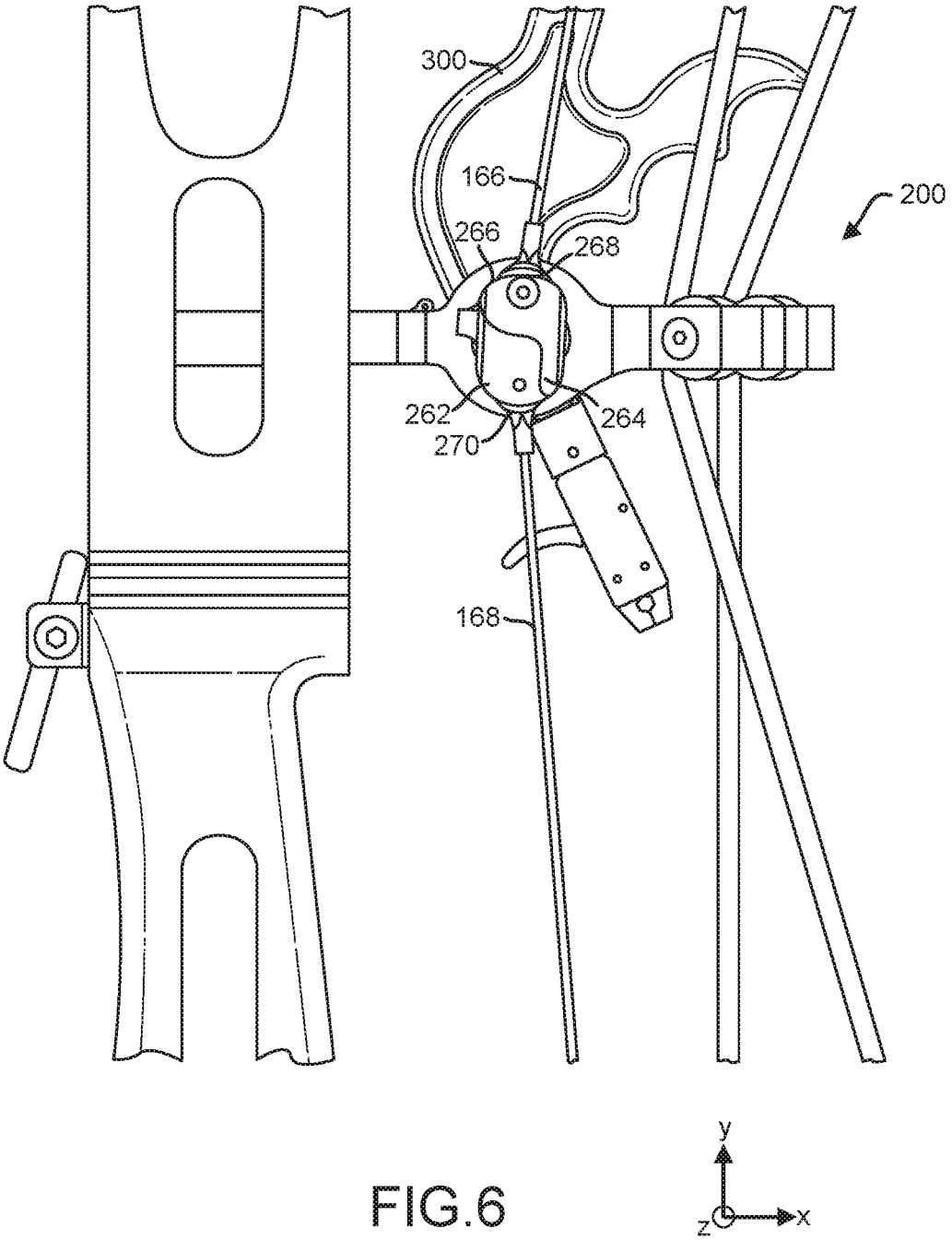
FIG. 6 illustrates a side view of a dual function lever coupled to an energy storage and relock mechanism of a power assisted bow in a rest position, in accordance with various embodiments.

Referring momentarily to FIG. 6, energy storage and relock mechanism 200 is illustrated from a second side, in accordance with various embodiments. Energy storage and relock mechanism 200 may comprise a charge cam 262 coupled to a second side of housing 230. Charge cam 262 may be configured to charge first auxiliary limb 118 and second auxiliary limb through first charge cable 166 and second charge cable 168, respectively (with momentary reference to FIG. 1). In various embodiments, charge cam 262 may comprise a substantially oval-shaped member configured to rotate relative to housing 230. Charge cam 262 may comprise a first finger 264 configured to interface with first charge cable 166 and a second finger 266 configured to interface with second charge cable 168. As illustrated herein, second finger 266 may be obstructed from view, but may be axially displaced from first finger 264, wherein axial may refer to a direction along the z-axis.

In various embodiments, first finger 264 and second finger 266 may comprise elongated members oriented in substantially opposite directions. For example, first finger 264 and second finger 266 may be oriented at approximately 180° from each other in various embodiments, however, are not limited in this regard. First charge cable 166 may be coupled to a first end 268 of charge cam 262, while second charge cable 168 may be coupled to a second end 270 of charge cam 262 substantially opposite the first end 268. In various embodiments, first end 268 and second end 270 may lie along the major axis of charge cam 262. In various embodiments, charge cam 262 may be coupled to charge shaft 232 (similar to charge cam lock washer 226 with reference to FIG. 2) such that charge cam 262 may rotate with charge shaft 232 on one side of housing 230, while charge cam lock washer 226 rotates with charge shaft 232 on the opposite side of housing 230. As will be discussed further below, as charge cam 262 rotates, first charge cable 166 and second charge cable 168 may be pulled inwardly, thereby deflecting first auxiliary limb 118 and second auxiliary limb 120 and storing energy in power assisted bow 100.

Figure 3:
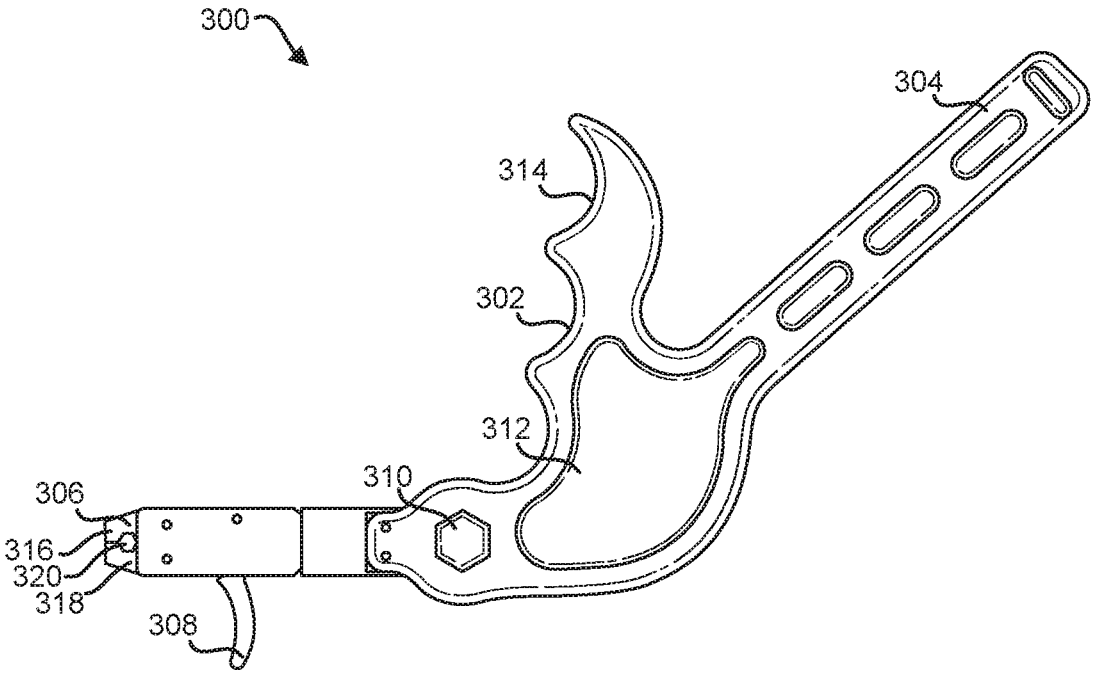
FIG. 3 illustrates a side view of a dual function lever to be used in conjunction with an energy storage and relock mechanism, in accordance with various embodiments.

Referring now to FIG. 3, a dual function lever 300 is illustrated from a side view, in accordance with various embodiments. Dual function lever 300 may be configured to be coupled to charge shaft 232 of energy storage and relock mechanism 200 and also be coupled to drawstring 142 of power assisted bow 100 (with momentary reference to FIG. 1 and FIG. 2). Dual function lever 300 may comprise a contoured grip 302, a lever arm 304, clamp 306, clamp release lever 308, shaft aperture 310, and one or more cutouts 312 configured to reduce a weight of dual function lever 300. Contoured grip 302 may comprise one or more semicircular surfaces 314 configured to provide grip for a user's hand. Clamp 306 may comprise a first jaw 316 and a second jaw 318 configured to rotate to open and close.

Figure 4:
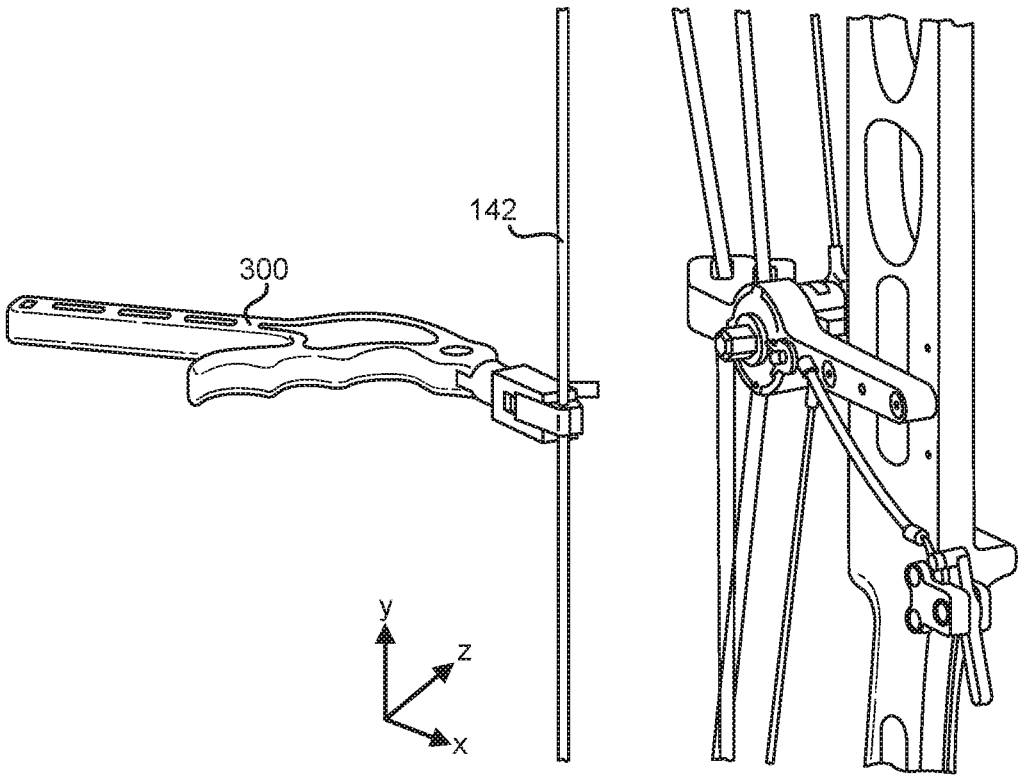
FIG. 4 illustrates a perspective view of a dual function lever coupled to power assisted bow drawstring, in accordance with various embodiments.

With reference to FIG. 3 and FIG. 4, first jaw 316 and second jaw 318 may define a drawstring aperture 320 when first jaw 316 and second jaw 318 are in a closed position. Drawstring aperture 320 may comprise a diameter substantially equal to that of drawstring 142 and may be configured to be coupled to drawstring 142 such that dual function lever 300 may assist a user in pulling drawstring 142. Once it is desired to release energy stored in power assisted bow 100 by releasing drawstring 142, clamp release lever 308 may be actuated, which may separate first jaw 316 and second jaw 318 and allow the drawstring 142 to be released from dual function lever 300.

Figure 5:
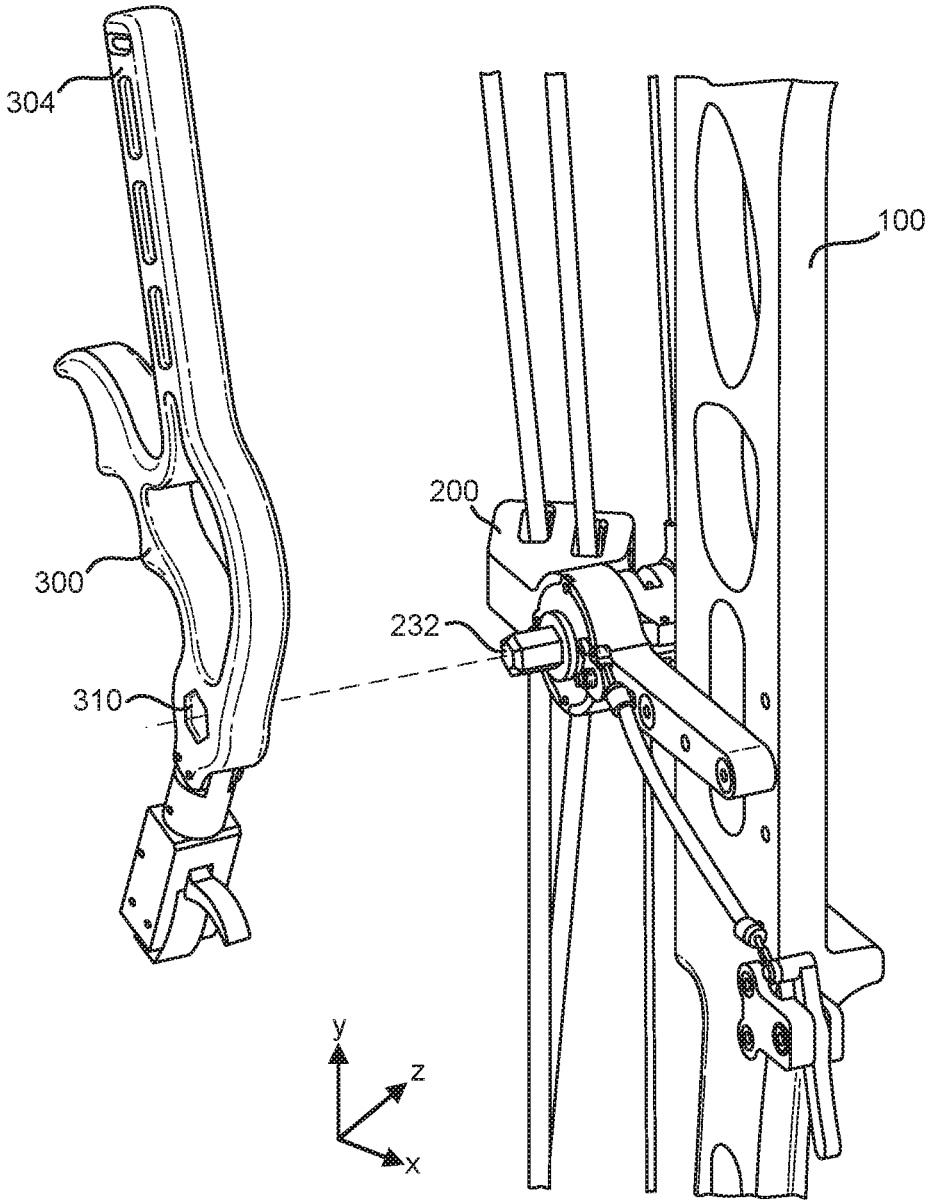
FIG. 5 illustrates an exploded view of a dual function lever coupled to an energy storage and relock mechanism of a power assisted bow, in accordance with various embodiments.

With reference now to FIG. 5, dual function lever 300 is illustrated adjacent to power assisted bow 100, in accordance with various embodiments. In various embodiments, shaft aperture 310 may be configured to mate with charge shaft 232, thereby allowing dual function lever 300 to charge energy storage and relock mechanism 200. Specifically, shaft aperture 310 of dual function lever 300 may comprise a complementary geometry to charge shaft 232. For example, in various embodiments, shaft aperture 310 and charge shaft 232 may each comprise a hexagonal geometry. Such geometry may increase a contact surface area between shaft aperture 310 and charge shaft 232. Dual function lever 300 may be coupled to charge shaft 232 via shaft aperture 310. Specifically, charge shaft 232 may be inserted through shaft aperture 310. Energy storage and relock mechanism 200 may be charged in response to rotation of dual function lever 300. Lever arm 304 may function as a moment arm allowing the user to apply a greater amount of rotational force to charge shaft 232 through dual function lever 300.

Returning now to FIG. 6, dual function lever 300 is illustrated coupled to energy storage and relock mechanism 200 while power assisted bow 100 is in a rest position, in accordance with various embodiments. In this position, power assisted bow 100 may be in the position illustrated in FIG. 1 with first auxiliary limb 118 and second auxiliary limb 120 in a rested, non-deflected position. As previously discussed, dual function lever 300 may be coupled to energy storage and relock mechanism 200 by placing charge shaft 232 through shaft aperture in dual function lever 300.

Figure 7:
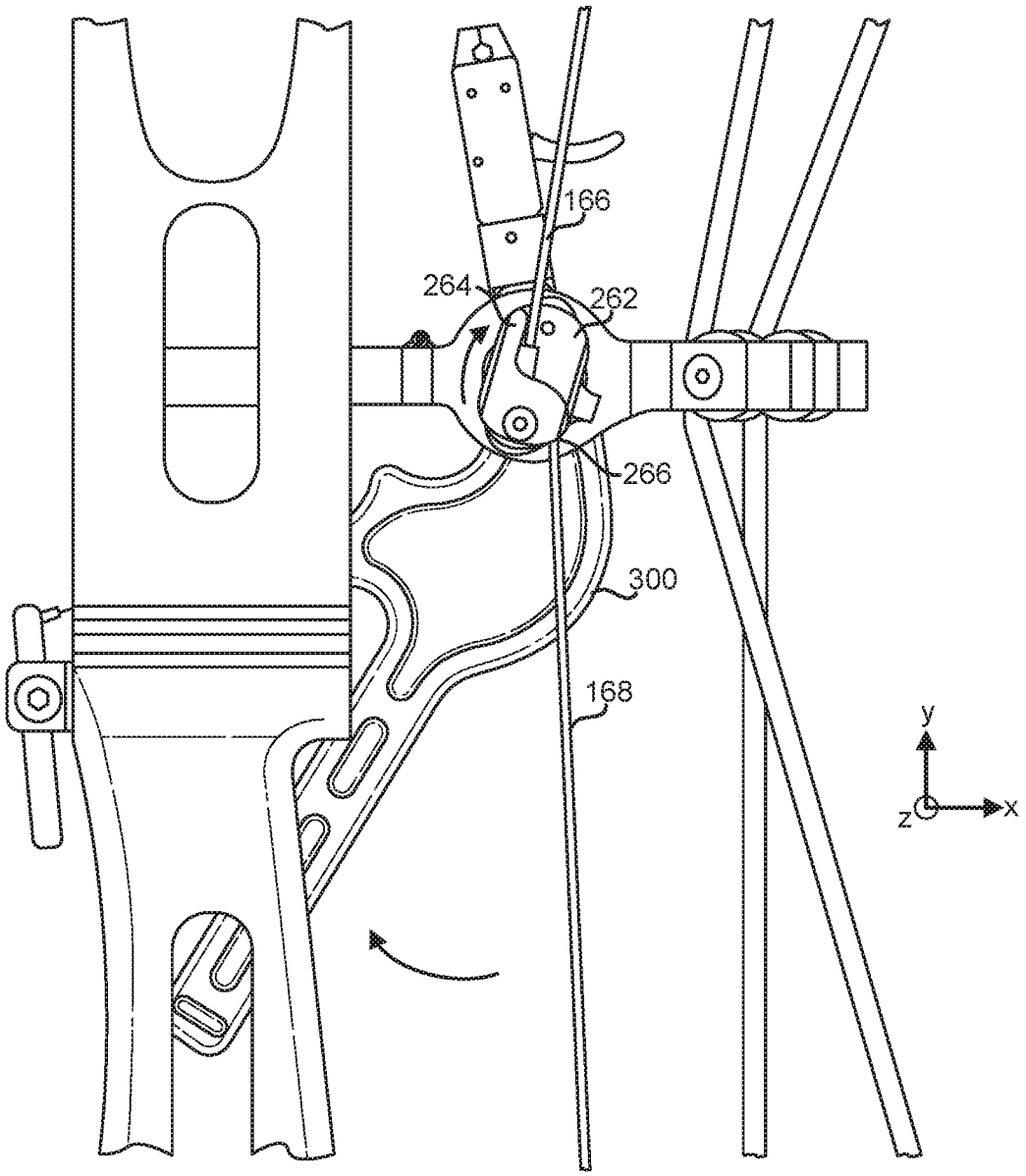
FIG. 7 illustrates a side view of a dual function lever coupled to an energy storage and relock mechanism of a power assisted bow in a charged locked position, in accordance with various embodiments.

Dual function lever 300 may allow a user to rotate charge cam 262 and/or charge cam lock washer 226 to charge power assisted bow 100. Charge cam lock washer 226 may be configured to corotate with charge cam lock washer 226. For example, referring to FIG. 6 and FIG. 7, in a rest position, charge cam 262 may be positioned substantially vertically, however, is not limited in this regard. In response to a user applying a force to dual function lever 300, charge cam 262 may rotate in a clockwise direction as illustrated in FIG. 7. Charge cam 262 and charge shaft 232 (FIG. 5) may continue to rotate until first finger 264 may contact first charge cable 166 and second finger 266 may contact second charge cable 168. As charge cam 262 rotates, first charge cable 166 and second charge cable 168 may be pulled inwardly (in a direction toward charge cam 262). In such a way, first charge cable 166 and second charge cable 168 under tension may cause first auxiliary limb 118 and second auxiliary limb 120 to deflect inward. Such inward deflection of first auxiliary limb 118 and second auxiliary limb 120 may "charge" power assisted bow 100 such that a portion of the total output energy of power assisted bow may be stored as potential energy in first auxiliary limb 118 and second auxiliary limb 120.

In various embodiments, the structure of charge cam 262, first finger 264, second finger 266, first charge cable, and second charge cable 168 may be configured that energy storage and relock mechanism 200 may be locked upon first finger 264 contacting first charge cable 166 and second finger 266 contacting second charge cable 168. In other words, upon being contacted by first finger 264 and second finger 266 respectively, first charge cable 166 and second charge cable 168 may deflect such that the energy stored in first auxiliary limb 118 and second auxiliary limb 120 remains stored in the limbs without the risk of the system releasing this stored energy prematurely. Therefore, in the charged position illustrated in FIG. 7, power assisted bow 100 may also be considered "locked" and may be stowed, carried, aimed, or otherwise maneuvered with all or a portion of the total potential energy stored in the system.

Figure 8:
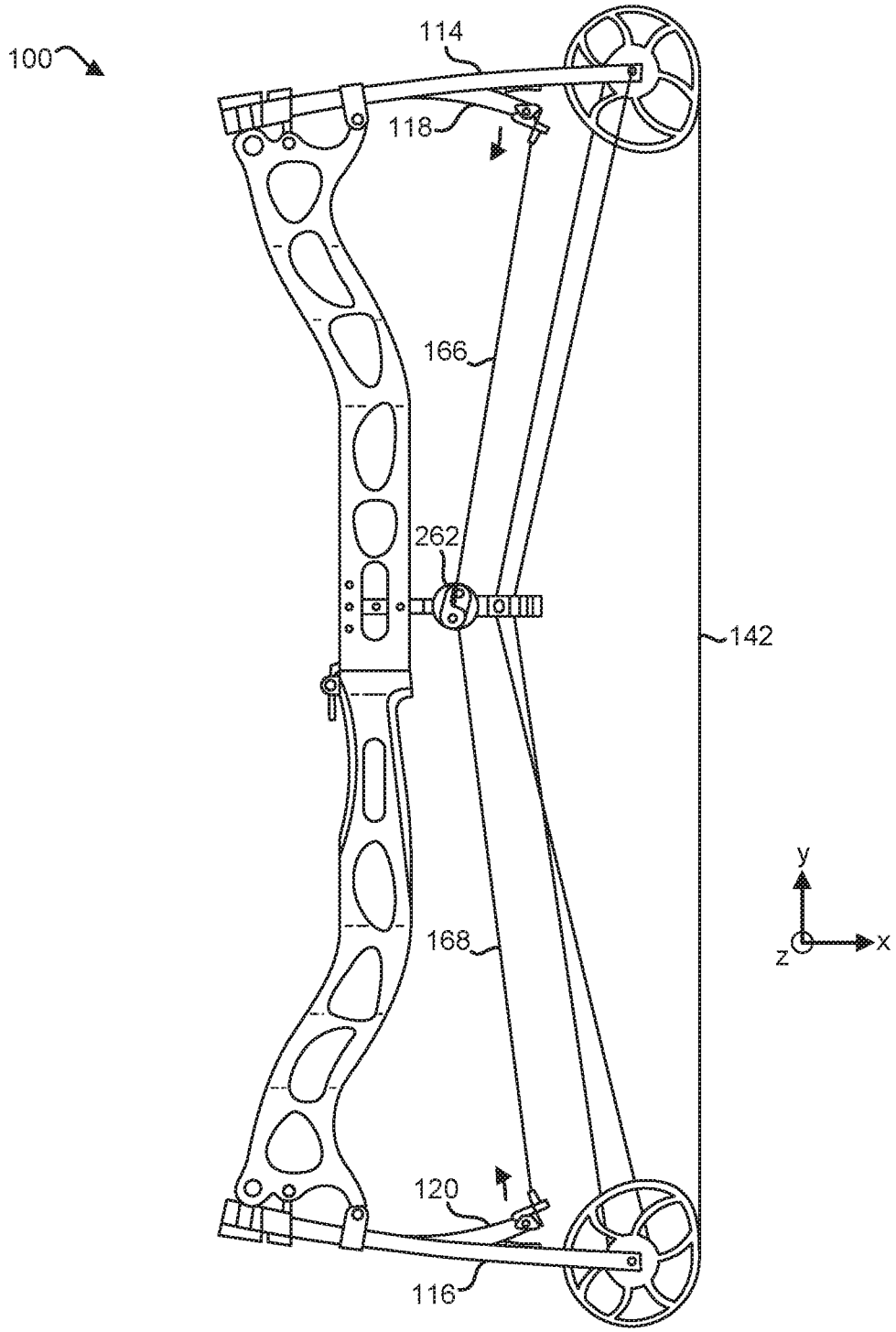
FIG. 8 illustrates a side view of a power assisted bow with an energy storage and relock mechanism in a charged locked position, in accordance with various embodiments.

Referring now to FIG. 8, power assisted bow 100 is illustrated from a side view in the charged locked position, in accordance with various embodiments. As previously stated, dual function lever 300 may be used to rotate charge cam 262, thereby causing first charge cable 166 and second charge cable 168 to become tensioned. This may cause first auxiliary limb 118 and second auxiliary limb 120 to deflect inwardly (as indicated by the arrows), thereby separating from first main limb 114 and second main limb 116, respectively. As further stated previously, the charged energy may be "locked" in power assisted bow 100. In this position, dual function lever 300 may be removed and coupled to drawstring 142.

Figure 9:
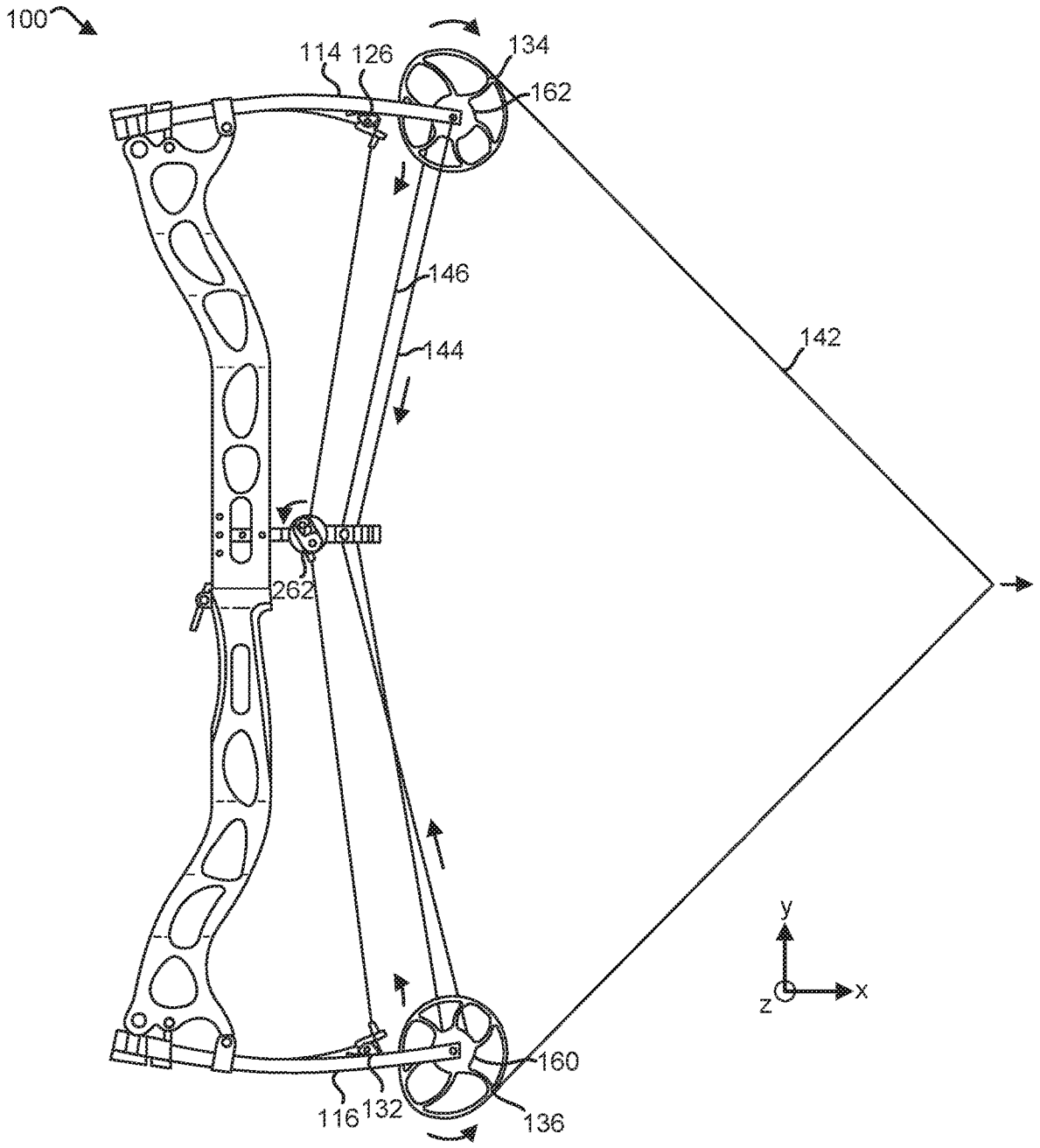
FIG. 9 illustrates a side view of a power assisted bow with an energy storage and relock mechanism in a charged fully drawn position, in accordance with various embodiments.

Referring now to FIG. 9, power assisted bow 100 is illustrated in a charged fully drawn position, in accordance with various embodiments. In various embodiments, drawstring 142 may be pulled using dual function lever 300. Power assisted bow 100 is not limited in this regard and drawstring 142 may be pulled using any suitable means, for example, a user's hand, finger or a device capable of pulling drawstring 142. In response to drawstring 142 being pulled, first cam 134 and second cam 136 may rotate in opposite directions due to drawstring being coupled to first cam 134 and second cam 136. In response, first buss cable 144 may wrap around inner profile 160 of second cam 136 and second buss cable 146 may wrap around inner profile 162 of first cam 134. As a result, first buss cable 144 being coupled to second main limb 116 and second buss cable 146 being coupled to first main limb 114 may cause first main limb 114 and second main limb 116 to deflect inwardly (as indicated by the arrows). First main limb 114 may contact first auxiliary limb 118 at first contact location 126 and second main limb 116 may contact second auxiliary limb 120 at second contact location 132. By contacting first auxiliary limb 118 and second auxiliary limb 120, respectively, first main limb 114 and second main limb 116 may relieve tension in first charge cable 166 and second charge cable 168. This may allow charge cam 262 to counterrotate (in the counterclockwise direction), thereby unlocking all of the stored energy in power assisted bow 100. At this stage, all of the energy stored in power assisted bow 100 may be released in response to drawstring 142 being released.

Figure 10:
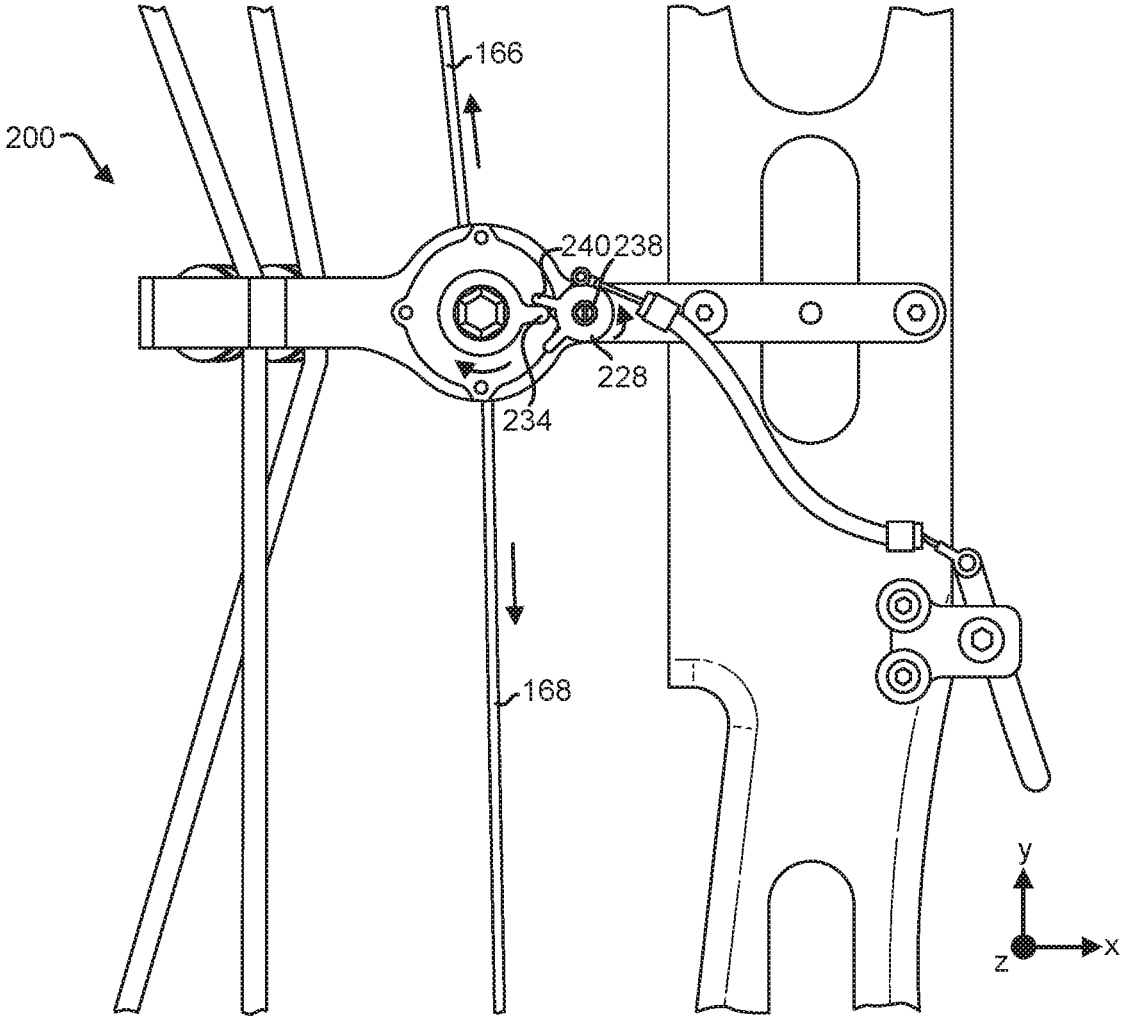
FIG. 10 illustrates an energy storage and relock mechanism of a power assisted bow in a fully drawn position from a first side, in accordance with various embodiments.

Referring now to FIG. 10, energy storage and relock mechanism 200 is illustrated from a first side while power assisted bow is in a charged fully drawn position, in accordance with various embodiments. As previously stated, in the charged fully drawn position, all energy stored in power assisted bow 100 may be released in response to a user releasing the drawstring. In this position, lock plate 228 may be positioned such that first tooth 240 is in contact with an upper portion of tooth 234 of charge cam lock washer 226. Lock plate 228 may be biased in the counterclockwise direction via biasing member 238. Biasing member 238 may be configured to urge rotation of the lock plate 228 to allow rotation of the charge cam 262 to release stored energy in power assisted bow 100. In response to the drawstring 142 being released, first main limb 114 and second main limb 116 may return to a non-deflected original position due to the elastic nature of first main limb 114 and second main limb 116. Following this, first auxiliary limb 118 and second auxiliary limb 120 may return to an original position due to the elastic nature of first auxiliary limb 118 and second auxiliary limb 120. As first auxiliary limb 118 and second auxiliary limb 120 expand outwardly, first auxiliary limb 118 and second auxiliary limb 120 may apply a tensile force to first charge cable 166 and second charge cable 168, thereby causing charge shaft 232 to counterrotate in the clockwise direction. In turn, rotating element 226 and charge cam 262 may also counterrotate, releasing energy stored in power assisted bow 100.

Figure 11:
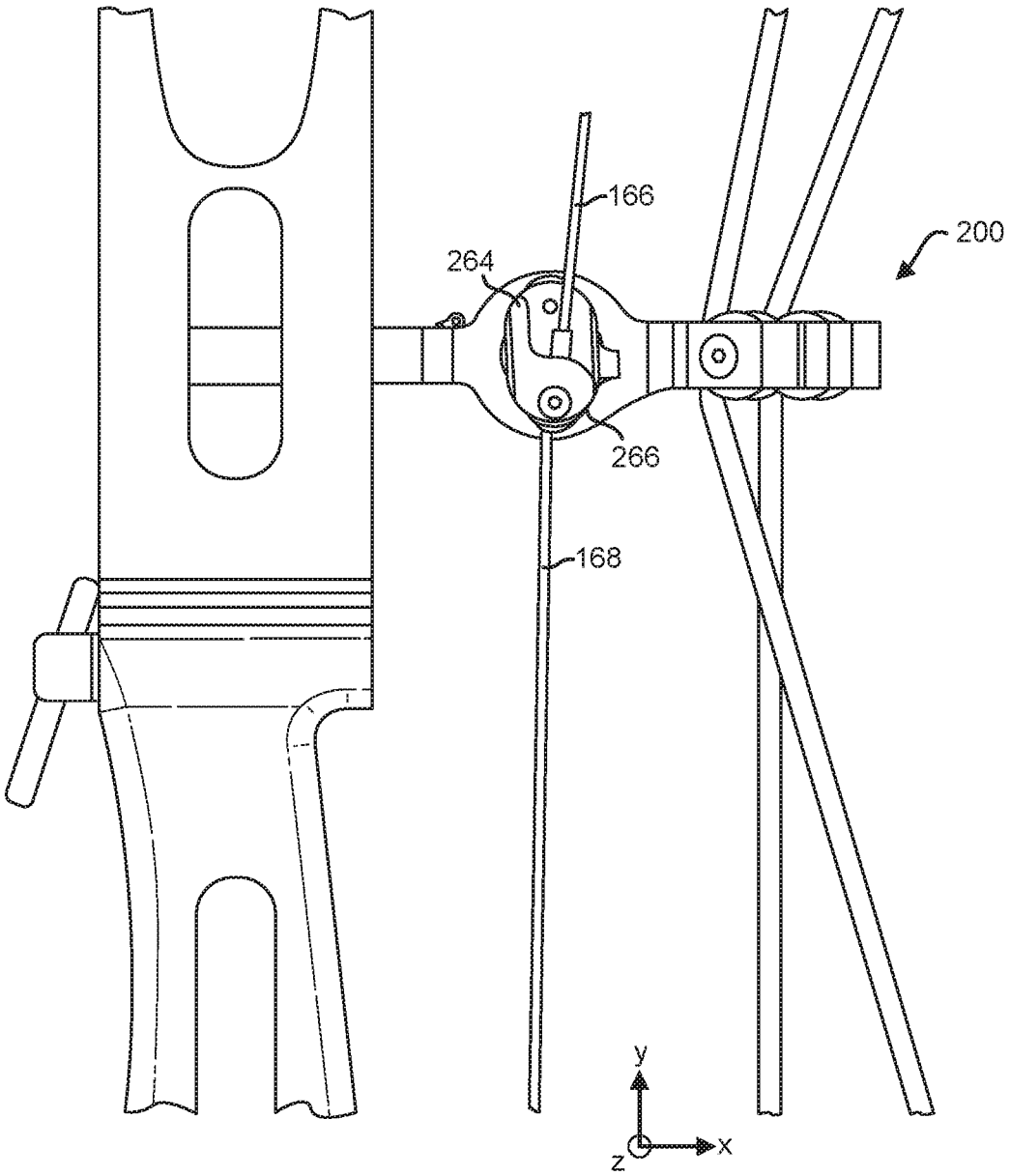
FIG. 11 illustrates an energy storage and relock mechanism of a power assisted bow in a fully drawn position from a second side, in accordance with various embodiments.

FIG. 11 illustrates energy storage and relock mechanism 200 from a second side while power assisted bow 100 is in charged fully drawn position. In the charged fully drawn position, first finger 264 and second finger 266 may be separated from first charge cable 166 and second charge cable 168, such that first finger 264 and second finger 266 do not contact first charge cable 166 and second charge cable 168, respectively. As previously discussed, stored energy in first auxiliary limb 118 and second auxiliary limb 120 may be "locked" when first finger 264 and second finger 266 are in contact with first charge cable 166 and second charge cable 168. As such, in the position illustrated in FIG. 11, all the energy stored in power assisted bow may be released upon releasing of the drawstring.

Figure 12:
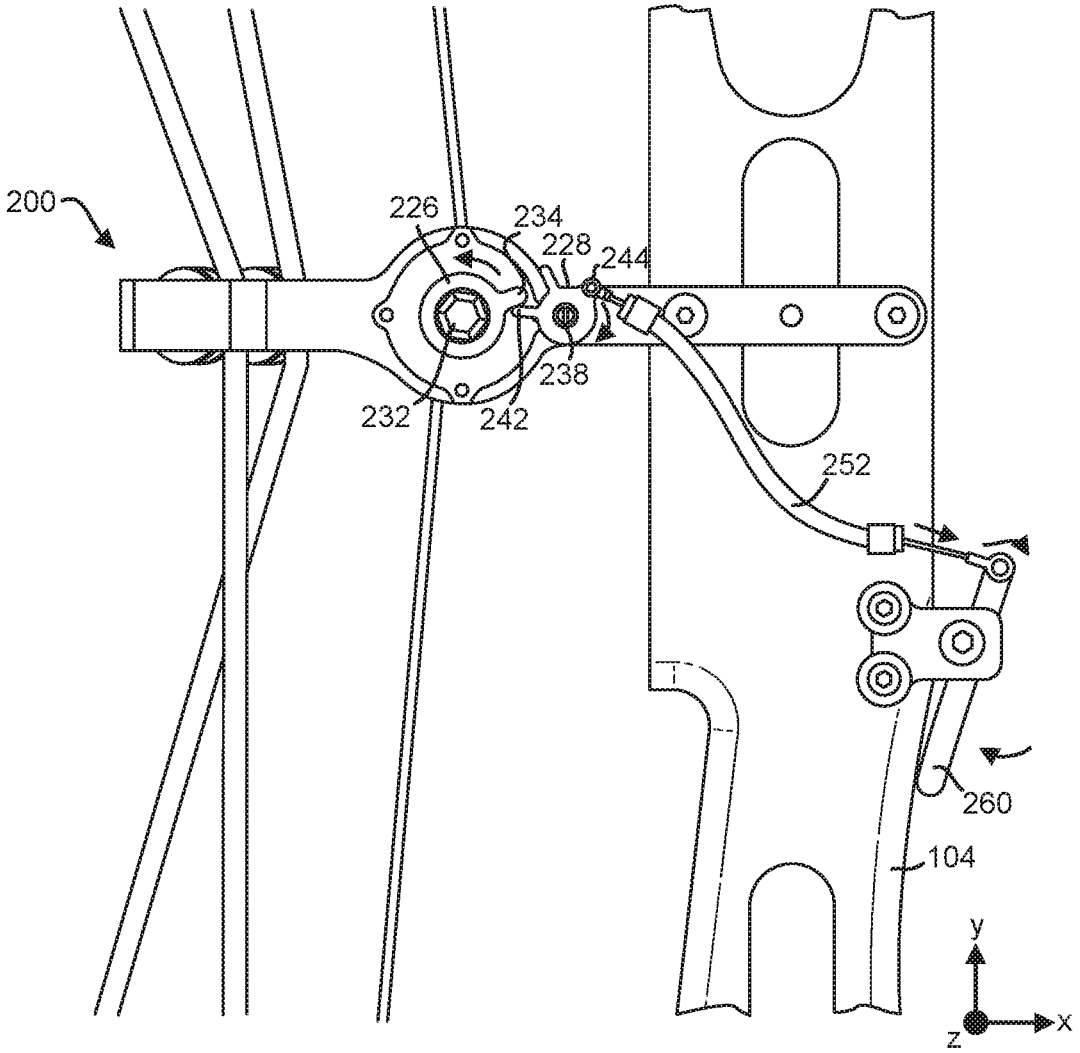
FIG. 12 illustrates an energy storage and relock mechanism of a power assisted bow in a charged relocked position from a first side, in accordance with various embodiments.
Figure 13:
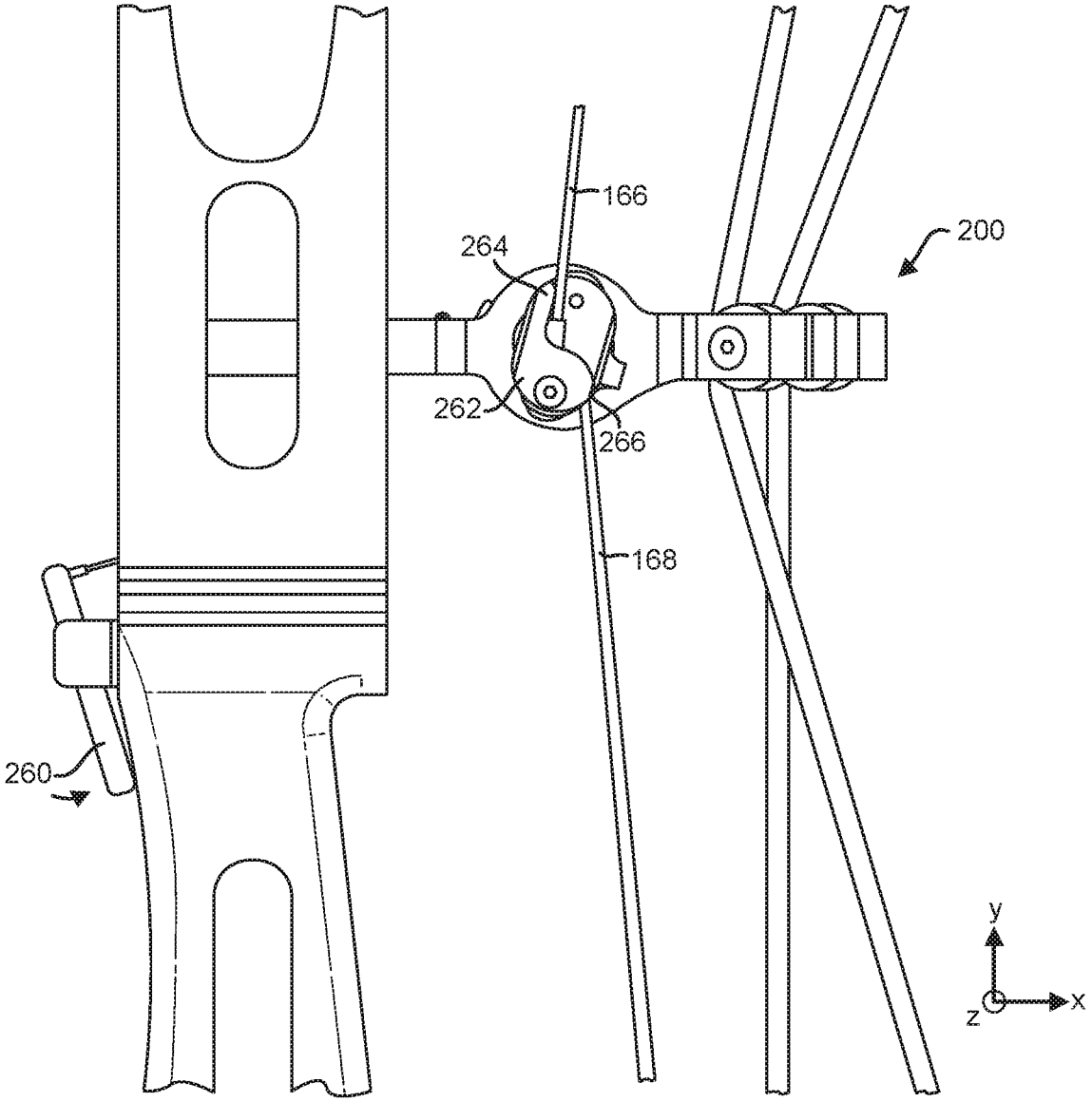
FIG. 13 illustrates an energy storage and relock mechanism of a power assisted bow in a charged relocked position from a second side, in accordance with various embodiments.

Referring now to FIG. 12 and FIG. 13, energy storage and relock mechanism 200 is illustrated in a charged relocked position, in accordance with various embodiments. In the event a user does not wish to release the drawstring when power assisted bow 100 is in a charged fully drawn position, energy storage and relock mechanism 200 may allow the prestored energy in the first auxiliary limb 118 and the second auxiliary limb 120 to remain stored in power assisted bow 100 as the user lets down the drawstring and prepares for another shot. More specifically, in response to a desire to let down the drawstring without releasing the energy stored in first auxiliary limb 118 and second auxiliary limb 120, relock lever 260 may be actuated. Relock lever 260 may be positioned adjacent to grip 104 such that relock lever 260 may be actuated without the need to adjust a position of a user's hand, in various embodiments.

As relock lever 260 is actuated (rotated in the direction indicated by the arrow), relock cord 252 coupled to one end of relock lever 260 may be tensioned, thereby exerting a force on boss 244. Such a force may be greater than the biasing force applied by biasing member 238 such that lock plate 228 rotates in a clockwise direction (as indicated by the arrows). In response, second tooth 242 of lock plate 228 may contact tooth 234 of charge cam lock washer 226, thereby counterrotating charge cam lock washer 226, charge shaft 232, and charge cam 262 (as indicated by the arrow), thereby relocking energy in energy storage and relock mechanism 200 and power assisted bow 100. FIG. 13 illustrates charge cam 262 in a charged relocked position. Similar to the charged locked position, first finger 264 and second finger 266 of charge cam 262 may contact first charge cable 166 and second charge cable 168, respectively, such that energy remains stored in first auxiliary limb 118 and second auxiliary limb 120 (not shown). Power assisted bow 100 may now be configured such that a user may redraw drawstring 142 and prepare for another shot, with the total energy in the bow at his or her disposal once again.

Figure 14:
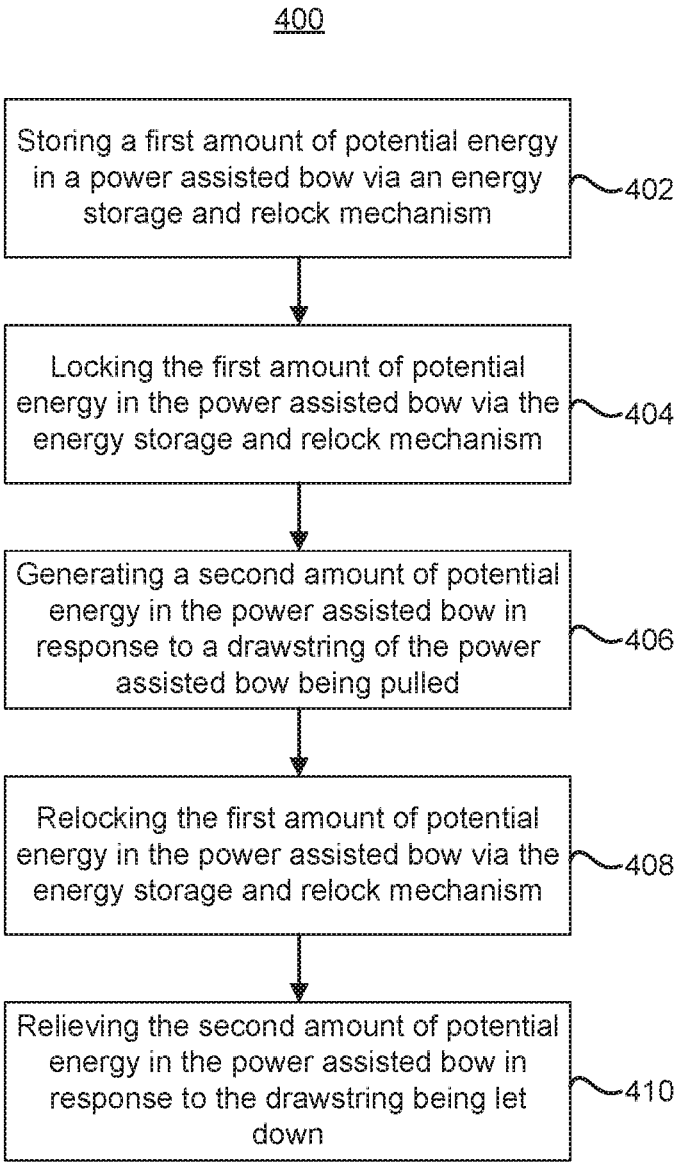
FIG. 14 illustrates a method of storing and relocking potential energy in a power assisted bow, in accordance with various embodiments.

A block diagram illustrating a method 400 of storing and relocking potential energy in a power assisted bow is illustrated in FIG. 14, in accordance with various embodiments. The method may comprise storing a first amount of potential energy in the power assisted bow via an energy storage and relock mechanism (step 402). The method may further comprise locking the first amount of potential energy in the power assisted bow via the energy storage and relock mechanism (step 404). The method may further comprise generating a second amount of potential energy in the power assisted bow in response to a drawstring of the power assisted bow being pulled (step 406). The method may further comprise relocking the first amount of potential energy in the power assisted bow via the energy storage and relock mechanism (step 408). The method may further comprise relieving the second amount of potential energy in the power assisted bow in response to the drawstring being let down (step 410).

Benefits, other advantages, and solutions to problems have been described herein with regard to specific embodiments. Furthermore, the connecting lines shown in the various figures contained herein are intended to represent exemplary functional relationships and/or physical couplings between the various elements. It should be noted that many alternative or additional functional relationships or physical connections may be present in a practical system. However, the benefits, advantages, solutions to problems, and any elements that may cause any benefit, advantage, or solution to occur or become more pronounced are not to be construed as critical, required, or essential features or elements of the disclosure. The scope of the disclosure is accordingly to be limited by nothing other than the appended claims, in which reference to an element in the singular is not intended to mean "one and only one" unless explicitly so stated, but rather "one or more." Moreover, where a phrase similar to "at least one of A, B, or C" is used in the claims, it is intended that the phrase be interpreted to mean that A alone may be present in an embodiment, B alone may be present in an embodiment, C alone may be present in an embodiment, or that any combination of the elements A, B and C may be present in a single embodiment; for example, A and B, A and C, B and C, or A and B and C. Different cross-hatching is used throughout the figures to denote different parts but not necessarily to denote the same or different materials.

Methods, apparatuses, and systems are provided herein. In the detailed description herein, references to "one embodiment", "an embodiment", "various embodiments", etc., indicate that the embodiment described may include a particular feature, structure, or characteristic, but every embodiment may not necessarily include the particular feature, structure, or characteristic. Moreover, such phrases are not necessarily referring to the same embodiment. Further, when a particular feature, structure, or characteristic is described in connection with an embodiment, it is submitted that it is within the knowledge of one skilled in the art to affect such feature, structure, or characteristic in connection with other embodiments whether or not explicitly described. After reading the description, it will be apparent to one skilled in the relevant art(s) how to implement the disclosure in alternative embodiments.

Furthermore, no element, component, or method step in the present disclosure is intended to be dedicated to the public regardless of whether the element, component, or method step is explicitly recited in the claims. No claim element herein is to be construed under the provisions of 35 U.S.C. 112(f) unless the element is expressly recited using the phrase "means for." As used herein, the terms "comprises", "comprising", or any other variation thereof, are intended to cover a non-exclusive inclusion, such that a process, method, article, or apparatus that comprises a list of elements does not include only those elements but may include other elements not expressly listed or inherent to such process, method, article, or apparatus.

What is claimed is:

1. An energy storage and relock mechanism for a power assisted bow, comprising:

a charge cam; and a lock plate adjacent to the charge cam, wherein the charge cam is configured to store potential energy by rotating in a first direction and wherein the lock plate is configured urge rotation of the charge cam in the first direction to lock potential energy in the power assisted bow.

2. The energy storage and relock mechanism of claim 1, further comprising a charge cam lock washer coupled to the charge cam and configured to interface with the lock plate.

3. The energy storage and relock mechanism of claim 2, wherein the charge cam lock washer comprises a tooth extending radially from the charge cam lock washer and the lock plate comprises a first tooth and a second tooth extending radially from the lock plate.

4. The energy storage and relock mechanism of claim 3, wherein the first tooth of the lock plate is configured to contact the tooth of the charge cam lock washer to urge rotation of the charge cam in the first direction.

5. The energy storage and relock mechanism of claim 1, wherein the lock plate comprises a biasing member configured to urge rotation of the lock plate to allow rotation of the charge cam in a second direction.

6. The energy storage and relock mechanism of claim 1, further comprising a relock cord coupled to the lock plate and a relock lever coupled to the relock cord, wherein the lock plate is configured to urge rotation of the charge cam in the first direction through actuation of the relock lever.

7. The energy storage and relock mechanism of claim 1, wherein the charge cam is configured to be coupled to a first charge cable on a first end and coupled to a second charge cable on a second end.

8. The energy storage and relock mechanism of claim 7, wherein the first charge cable and the second charge cable are configured to become tensioned in response to the charge cam rotating in the first direction.

9. The energy storage and relock mechanism of claim 1, further comprising an attachment member configured to couple the energy storage and relock mechanism to a central body of the power assisted bow.

10. A power assisted bow, comprising:

an energy storage and relock mechanism, comprising:

a charge cam; and a lock plate adjacent to the charge cam, wherein the charge cam is configured to store potential energy by rotating in a first direction and wherein the lock plate is configured urge rotation of the charge cam in the first direction to lock potential energy in the power assisted bow.

11. The power assisted bow of claim 10, further comprising a first charge cable and a second charge cable coupled to the charge cam and configured to become tensioned in response to the charge cam rotating in the first direction.

12. The power assisted bow of claim 11, further comprising a first auxiliary limb and a second auxiliary limb coupled to the first charge cable and second charge cable, respectively, the first auxiliary limb and the second auxiliary limb configured to deflect inwardly in response to the charge cam rotating in the first direction.

13. The power assisted bow of claim 10, wherein the energy storage and relock mechanism is coupled to a central body of the power assisted bow adjacent to a grip.

14. The power assisted bow of claim 10, further comprising a charge cam lock washer coupled to the charge cam and configured to interface with the lock plate.

15. The power assisted bow of claim 14, wherein a first tooth of the lock plate is configured to contact a tooth of the charge cam lock washer to urge rotation of the charge cam in the first direction.

16. The power assisted bow of claim 10, wherein the lock plate comprises a biasing member configured to urge rotation of the lock plate to allow rotation of the charge cam in a second direction.

17. The power assisted bow of claim 10, wherein the charge cam is configured to store a fraction of a total amount of potential energy to be stored in the power assisted bow by rotating in the first direction.

18. A method of storing and relocking potential energy in a power assisted bow, comprising:

storing a first amount of potential energy in the power assisted bow via an energy storage and relock mechanism;

locking the first amount of potential energy in the power assisted bow via the energy storage and relock mechanism;

generating a second amount of potential energy in the power assisted bow in response to a drawstring of the power assisted bow being pulled;

relocking the first amount of potential energy in the power assisted bow via the energy storage and relock mechanism; and relieving the second amount of potential energy in the power assisted bow in response to the drawstring being let down.

19. The method of claim 18, wherein the energy storage and relock mechanism comprises a charge cam configured to store the first amount of potential energy by rotating in a first direction.

20. The method of claim 19, wherein the energy storage and relock mechanism further comprises a lock plate configured to relock the first amount of potential energy by urging rotation of the charge cam in the first direction.

* * * * *